US010544992B2

(12) United States Patent
Cook

(10) Patent No.: US 10,544,992 B2
(45) Date of Patent: Jan. 28, 2020

(54) MULTICHAMBER HEAT EXCHANGER

(71) Applicant: Clean Rolling Power, Fullerton, CA (US)

(72) Inventor: David Cook, Fullerton, CA (US)

(73) Assignee: Clean Rolling Power, LLC, Fullerton, CA (US)

( * ) Notice: Subject to any disclaimer, the term of this patent is extended or adjusted under 35 U.S.C. 154(b) by 106 days.

(21) Appl. No.: 15/452,717

(22) Filed: Mar. 7, 2017

(65) Prior Publication Data

US 2017/0176111 A1 Jun. 22, 2017

Related U.S. Application Data

(63) Continuation of application No. 13/978,687, filed as application No. PCT/US2012/020566 on Jan. 6, 2012, now Pat. No. 9,587,889.

(60) Provisional application No. 61/430,530, filed on Jan. 6, 2011.

(51) Int. Cl.

| | |
|---|---|
| ***F28D 9/00*** | (2006.01) |
| ***F28F 9/02*** | (2006.01) |
| ***F28D 21/00*** | (2006.01) |

(52) U.S. Cl.

CPC ..... *F28D 9/0093* (2013.01); *F28D 9/0037* (2013.01); *F28D 9/0062* (2013.01); *F28D 21/0001* (2013.01); *F28D 21/0003* (2013.01); *F28F 9/026* (2013.01); *F28F 9/0221* (2013.01); *F28D 21/0014* (2013.01); *F28F 2265/26* (2013.01)

(58) Field of Classification Search

CPC ..... F28D 1/05366; F28D 1/05316; F28D 9/0093; F28D 9/0037; F28D 9/0062; F28D 21/0003; F28F 9/0221; F28F 9/026

USPC ..... 165/144

See application file for complete search history.

(56) References Cited

U.S. PATENT DOCUMENTS

| | | | | |
|---|---|---|---|---|
| 6,189,491 | B1 * | 2/2001 | Wittchow | F22B 1/1815 122/1 C |
| 7,017,529 | B1 * | 3/2006 | Lomax, Jr. | F22B 1/02 122/235.15 |
| 2008/0104960 | A1 * | 5/2008 | Lomax | F22B 21/16 60/653 |
| 2011/0056668 | A1 * | 3/2011 | Taras | F28D 1/0478 165/174 |

* cited by examiner

*Primary Examiner* — Tho V Duong
(74) *Attorney, Agent, or Firm* — Richards Patent Law P.C.

(57) ABSTRACT

A heat exchanger system comprises a first heat exchanger, a second heat exchanger, a mixer, and a third heat exchanger. A first working fluid flow path connects the first working fluid outlet port and the first mixer inlet port, a second working fluid flow path connects the second working fluid outlet port and the second mixer inlet port, and a third working fluid flow path connects the mixer outlet and the third inlet port.

14 Claims, 10 Drawing Sheets

DETAIL A

MULTICHAMBER HEAT EXCHANGER

CROSS-REFERENCE TO RELATED APPLICATIONS

This application comprises a continuation of U.S. patent application Ser. No. 13/978,687 filed Jul. 8, 2013, which is a U.S. National Stage Entry of PCT/US12/20566 filed Jan. 6, 2012, which incorporates by reference and claims priority to U.S. Provisional Patent Application No. 61/430,530 filed Jan. 6, 2011, each of which is incorporated in its entirety.

BACKGROUND OF THE INVENTION

The present invention relates to heat exchangers and specifically those which directly extract heat from high temperature media streams and transfer this heat to a heat sensitive working fluid and/or heat exchangers which combine a plurality of separate heat exchange zones within a single physical package.

Analyses of mobile waste heat recovery systems (WHRS) which extract energy from ICEs suggest that using a medium other than water, such as a refrigerant, is advantageous for a Rankine-cycle WHRS operating from heat sources lower than 650 C. Known issues with using water as a rankine cycle working fluid include: the potential for damage to the turbine and other parts of the WHRS flow path due to the corrosive nature of high temperature and pressure steam; and getting a high enough pressure ratio across the turbine. While this is feasible in a typical stationary steam power plant, which may run the working fluid up to a temperature of 600 C at 30 MPa, these conditions are difficult to achieve in a mobile application.

Refrigerant use, however, comes with a challenge—above fairly moderate temperatures (~250 C for R245fa) the fluid is susceptible to permanent and irrevocable damage. A safe solution would be to use a pair of intermediate heat exchangers and a heat transfer fluid that could run at temperatures closer to the ICE exhaust gas temperature. This solution would add bulk, cost, and weight to the system.

A single stage heat exchanger without such an intermediate heat transfer solution would have opposing surfaces exposed to 560 C on one side and less than 250 C on the opposite side. Since heat transfer characteristics are inversely proportional to the thickness of the material between the fluids, one would want to minimize the thickness of the material. The thinner the sheet of material, the less surface area is required to transfer the heat, which leads to lower pressure drop, lower cost and reduced weight. However, thinner sheets also have a significant downside—internal stresses will be quite high due to the thermal stresses caused by the opposing surface temperatures and corresponding thermal expansion and strains. Finding a way to minimize the temperature differential on opposing sides of the sheet will provide the basis for the development of an efficient, low-cost, light-weight heat exchanger which is the core component of a WHRS.

Another challenge faced by mobile WHRS is the need to package the system compactly. Such systems typically comprise condensers, pumps, turbines, and heat exchangers. For a system which extracts heat from a plurality of sources, the heat exchangers can be the most volumetrically expensive system components. The reason for this is that in the existing art, each heat exchanger is a separate component, requiring its own mounting hardware, insulation, accessible inlets and outlets, fittings, insulated pipes, etc.

SUMMARY OF THE INVENTION

In view of the foregoing disadvantages inherent in the known types of heat exchangers now present in the prior art, the present disclosure provides an improved apparatus by employing a multi-zone approach for efficiently extracting heat from a media stream without risking damage to the working fluid. The present disclosure also provides an improved apparatus for packaging multiple, nominally independent, heat exchangers into a single physical package.

The present invention, while being applicable to heat engines, is particularly applicable to mobile heat engines. Mobile waste heat recovery systems have been disclosed which comprise a closed-loop flow path for a working fluid; a condenser; two high pressure circuits, in parallel, each comprising; a pump; a plurality of heat exchangers; and an expander; and a means for controlling said apparatus. Such systems are capable of extracting useful work from a plurality of waste heat media streams.

Such WHRSs are particularly applicable to mobile systems with diesel fueled ICEs because there exists meaningful amounts of energy to extract from each of the plurality of waste heat media streams. Enabling such a system requires heat exchangers which can transfer heat from very hot waste heat media streams, such as engine exhaust, and relatively low waste heat media streams, such as engine coolant. The present invention employs a multi-zone approach which allows a high temperature waste heat media stream to transfer heat to the working fluid without risk of damage, and does so in a compact manner using a brazed plate heat exchanger approach, which relies on readily available manufacturing techniques.

The present invention also provides a means for packaging several heat exchangers into a single physical package while maintaining separate heat transfer paths. The present invention employs conduits for bypassing heat exchanger zones, which combined with brazed plate heat exchanger technologies and readily available manufacturing techniques allows packaging several heat exchangers and a flow splitter into a single insulated physical package.

In one example, a heat exchanger includes: a housing; a working fluid inlet and a working fluid outlet in the housing through which a working fluid enters and exits the housing, respectively, wherein a working fluid flow path connects the working fluid inlet and the working fluid outlet; and a heat transfer medium inlet and a heat transfer medium outlet in the housing through which a heat transfer medium enters and exits the housing, respectively; wherein a heat transfer medium flow path connects the heat transfer medium inlet and the heat transfer medium outlet; further wherein the heat transfer medium flow path includes at least two distinct zones of operation including a radiation dominant zone and a conduction dominant zone. In a preferred embodiment, the radiation dominant zone is located closer to the heat transfer medium inlet than the conduction dominant zone.

In order for the heat transfer medium path to maintain the ability to fit within a given cross-sectional area, the cross-section of the radiation dominant zone and the cross-section of the conduction dominant zone may be sized such that each may be contained within a common cross-sectional area.

Certain embodiments of the heat exchanger may further include two or more heat transfer medium inlets and two or more heat transfer medium outlets in the housing through which two or more heat transfer media enter and exit the housing, respectively, wherein two or more heat transfer medium flow paths connect the two or more heat transfer medium inlets and the two or more heat transfer medium outlets, respectively.

One of the advantages of the heat exchanger disclosed herein is that in some embodiments, in the radiation dominant zone, the heat transfer medium flow path is free to expand as needed without the material experiencing significant material stress due to restrained thermal expansion. This is accomplished by not restricting the expansion of the outer structural elements of the heat transfer medium flow path.

In some embodiments, in the radiation dominant zone, the heat transfer medium flow path is formed from a material having a relatively high surface area to mass ratio when compared to the conduction dominant zone and may further include an exterior surface treatment to enhance emissivity. Still further, in the radiation dominant zone, the exchange media flow path may transition from a higher thermal resistance closer to the heat transfer medium inlet to a lower thermal resistance closer to the heat transfer medium outlet. For example, in the radiation dominant zone, the working fluid flow path may include a fin adapted to increase the radiation heat transfer rate, wherein the fin varies in exposed area along the working fluid flow path, with a greater exposed fin area closer to the exchange media inlet.

The heat transfer medium flow path of the heat exchanger may further include a transition zone between the radiation dominant zone and the conduction dominant zone. In some embodiments, the heat transfer medium flow path is brazed to the working fluid flow path in the transition area.

It is contemplated that in some embodiments, in the transition zone, the heat transfer medium flow path includes a section that is closer to the heat transfer medium inlet that is a higher thermal resistance and a section that is closer to the heat transfer medium outlet that is a lower thermal resistance. It is further contemplated that in some embodiments, in the transition zone, the heat transfer medium flow path includes a section that is closer to the heat transfer medium inlet that is in contact with the working fluid flow path and not brazed to the working fluid flow path and a section that is closer to the heat transfer medium outlet that is both in contact with and brazed to the working fluid flow path. In such versions, the section of the heat transfer medium flow path that is in contact with the working fluid flow path and not brazed to the working fluid flow path may include a protective coating.

In other embodiments, in the transition area, the media exchange flow path contacts the working fluid flow path by physical contact only and is not brazed to the working fluid flow path. In such an embodiment, the media exchange flow path and the working fluid flow path may be separated by a protective coating in the transition area.

Within the conduction dominant zone, the heat transfer media flow path may include one or more fins within which a sealed volume of air is trapped inside which increases the speed of the heat transfer media to increase overall heat transfer efficiency. The one or more fins may be larger in cross-sectional area towards the heat transfer medium outlet than towards the heat transfer medium inlet.

It is further contemplated that the heat exchanger may be adapted such that, within the housing, the working fluid flow path and the heat transfer fluid flow path form a plurality of thermally separated heat transfer zones and further wherein the working fluid flow path and heat transfer fluid flow path each include a plurality of bypasses corresponding to the number of thermally separated heat transfer zones. These bypasses may be active or passive flow control mechanisms. The bypasses enable the heat exchanger to transport or direct the working fluid(s) and heat transfer media to only those zone(s) where they are needed.

Advantages of the hybrid BPHE for exhaust gasses include:

Extremely light weight due to the use of thin materials;

Low cost, due to the use of industry-standard brazing processes, which is allowed due to the physical isolation of the high temperature gasses in a very low pressure and stress area; and Higher effectiveness due to ability reduce the exhaust gas temperatures to very low temperatures and to discharge acidic condensate to a low stress repairable section of the heat exchanger.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

DESCRIPTION OF THE DRAWINGS

The above, as well as other advantages of the present disclosure, will become readily apparent to those skilled in the art from the following detailed description, particularly when considered in the light of the drawings described herein.

DEFINITIONS

Figure 1:
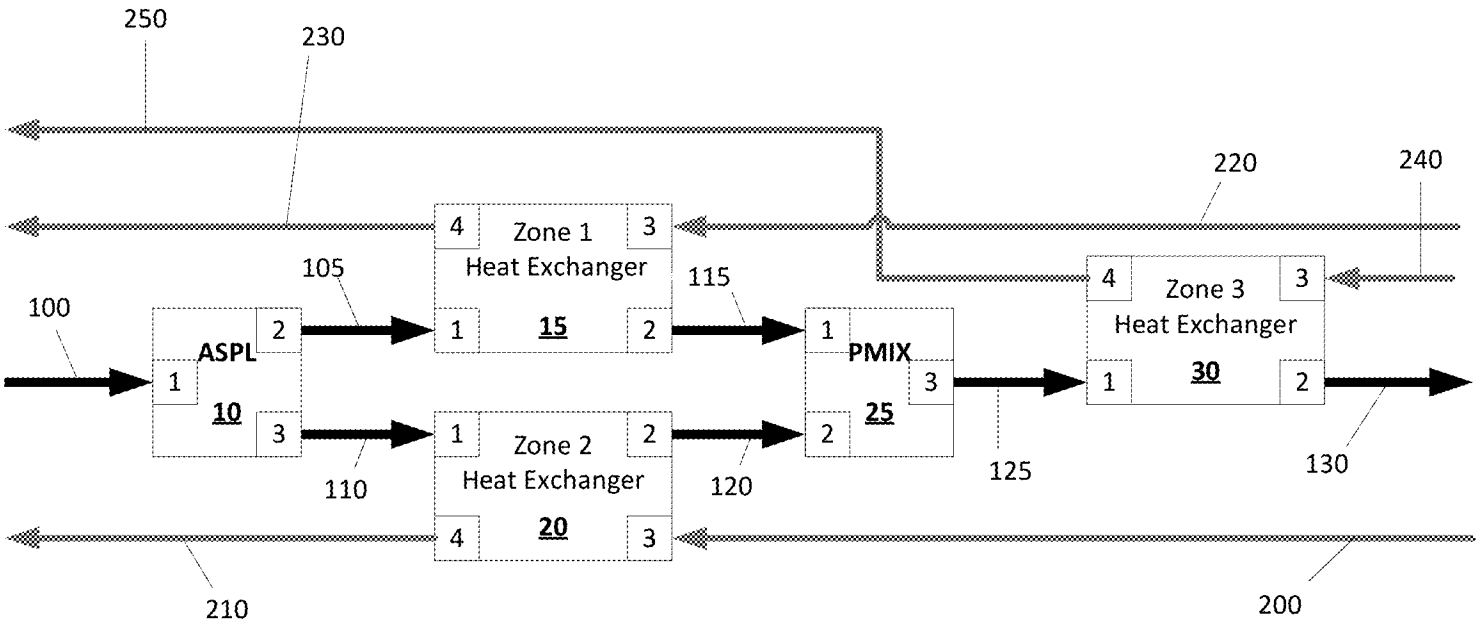
FIG. 1 shows a schematic of a portion of a thermal cycle in which heat is exchanged between three heat transfer medium streams and a working fluid stream using three heat exchangers.

To facilitate an understanding of the present invention, a number of terms and phrases are defined below:

Heat exchanger: a device where two fluids flow within their own physically isolated passages for the purpose of transferring heat from one heat transfer medium at a higher temperature to a heat transfer medium at a lower temperature.

Brazed plate heat exchanger (BPHE): A heat exchanger for which flow passages exist between multiple sheets of material that are braised together as a single brazed structure, with alternating isolated flow passages for at least two heat transfer media.

Fluid: Means any gas or liquid.

Heat engine: A combination of components used to extract useful energy from one or more heat sources.

Heat transfer medium: A gas or liquid, initially at a higher or lower temperature (with respect to a desired operating point), whose temperature is reduced or increased by passage through the heat exchanger. In this disclosure, the following terms are used equivalently: Heat transfer medium, exchange media or just media.

Internal combustion engine (ICE): A type of heat engine that produces mechanical power by internally combusting a mixture of air and fuel. Among others, types of ICEs include piston operated engines and turbines. Piston operated engines may be spark or compression ignited. Fuels used by ICEs include gasoline, diesel, alcohol, dimethyl ether, JP8, biodiesel, various blends, and the like.

Working fluid: A heat transfer medium used in a heat engine. In a heat engine comprising a closed loop rankine cycle, the fluid is specifically selected to condense and boil at pressures and temperatures conducive to converting heat energy to work with available heat source and sinks. Certain working fluids, such as certain refrigerants, which are beneficially used in waste heat recovery systems, are typically sensitive to damage from operating at excessively high temperatures, such as those which may be experienced in a small portion of a heat exchanger circuit. In this disclosure, the following terms are used equivalently: Working Fluid, WF, Rankine Media, or RM.

DETAILED DESCRIPTION OF THE INVENTION

The following description is merely exemplary in nature and is not intended to limit the present disclosure, application, or uses. It should also be understood that throughout the drawings, corresponding reference numerals indicate like or corresponding parts and features. In respect of the methods disclosed, the order of the steps presented is exemplary in nature, and thus, is not necessary or critical. In addition, while much of the present invention is illustrated using application to diesel electric locomotive examples, the present invention is not limited to these preferred embodiments.

FIG. 1 shows a schematic of a portion of a thermal cycle in which heat is exchanged between three heat transfer medium streams and a working fluid stream using three heat exchangers. One example of where such an embodiment of heat exchangers may occur is within certain waste heat recovery systems. In said embodiment, the working fluid 100 is used to extract heat from heat transfer media streams 200, 220, and 240. In one configuration of the system, the zone 1 heat exchanger 15, hereafter Z1HE, can be a recuperator, the zone 2 heat exchanger 20, hereafter Z2HE, can be an intercooler heat exchanger, and the zone 3 heat exchanger 30, hereafter Z3HE, can be a jacket water heat exchanger.

Working fluid 100 enters controlled splitter 10, hereafter ASPL, at inlet port 1. Based on some control signal, a portion of the WF 100 is directed to outlet port 2 of ASPL 10 and the remainder of the fluid is directed to outlet port 3 of ASPL 10.

Z1HE 15 takes in a heat transfer medium stream 220 at inlet port 3 and after transferring heat to the working fluid 105 flowing through the opposite chamber of the heat exchanger, cooled heat transfer medium 230 exits Z1HE 15 at outlet port 4. Z1HE 15 inlet port 1 takes in WF 105. As WF 105 flows through Z1HE 15, heat is transferred to WF 105, which depending on the circuit may raise the temperature of WF 105, cause WF 105 to boil, and/or superheat WF 105. Heated WF 115 exits Z1HE 15 at outlet port 2, from which it flows to inlet port 1 of a passive mixer 25, hereafter PMIX.

Z2HE 20 takes in a heat transfer medium stream 200 at inlet port 3 and after transferring heat to the working fluid 110 flowing through the opposite chamber of the heat exchanger, cooled heat transfer medium 210 exits Z2HE 20 at outlet port 4. Z2HE 20 inlet port 1 takes in WF 110. As WF 110 flows through Z2HE 20, heat is transferred to WF 110, which depending on the circuit may raise the temperature of WF 110, cause WF 110 to boil, and/or superheat WF 110. Heated WF 120 exits Z2HE 20 at outlet port 2, from which it flows to inlet port 2 of PMIX 25.

In alternative embodiments, ASPL 10 is passive and PMIX 25 is controlled, or both could be passive.

Within PMIX 25, working fluid streams 115 and 120 are combined. The combined working fluid stream 125 exits PMIX 25 at port 3.

Z3HE 30 takes in a heat transfer medium stream 240 at inlet port 3 and after transferring heat to the working fluid 125 flowing through the opposite chamber of the heat exchanger, cooled heat transfer medium 250 exits Z3HE 30 at outlet port 4. Z3HE 30 inlet port 1 takes in WF 125. As WF 125 flows through Z3HE 30, heat is transferred to WF 125, which depending on the circuit may raise the temperature of WF 125, cause WF 125 to boil, and/or superheat WF 125. Heated WF 130 exits Z3HE 30 at outlet port 2.

This embodiment is exemplary in nature. It is understood that in alternative embodiments the heat exchangers 15, 20 and 30 may serve different purposes and the working fluid 100 may be a source of heat as opposed to a heat sink.

While a three heat exchanger system as described in FIG. 1 is potentially beneficial for a number of applications, limitations in the current art, specifically the need to instantiate each of the heat exchangers 15, 20 and 30 as separate devices, greatly limits the applicability of such a system.

Figure 2:
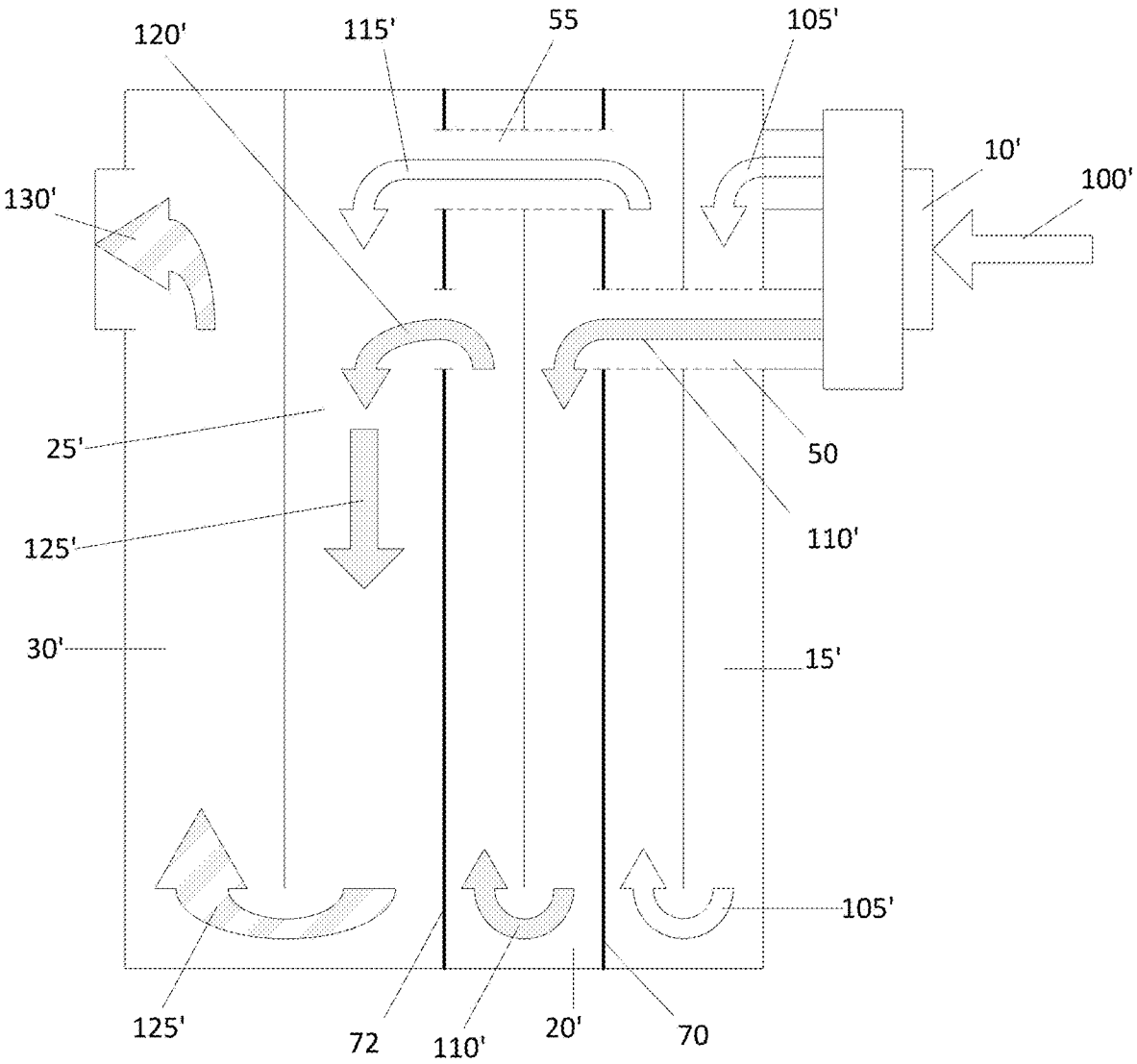
FIG. 2 shows the working fluid portion of a three zone heat exchanger.
Figure 3:
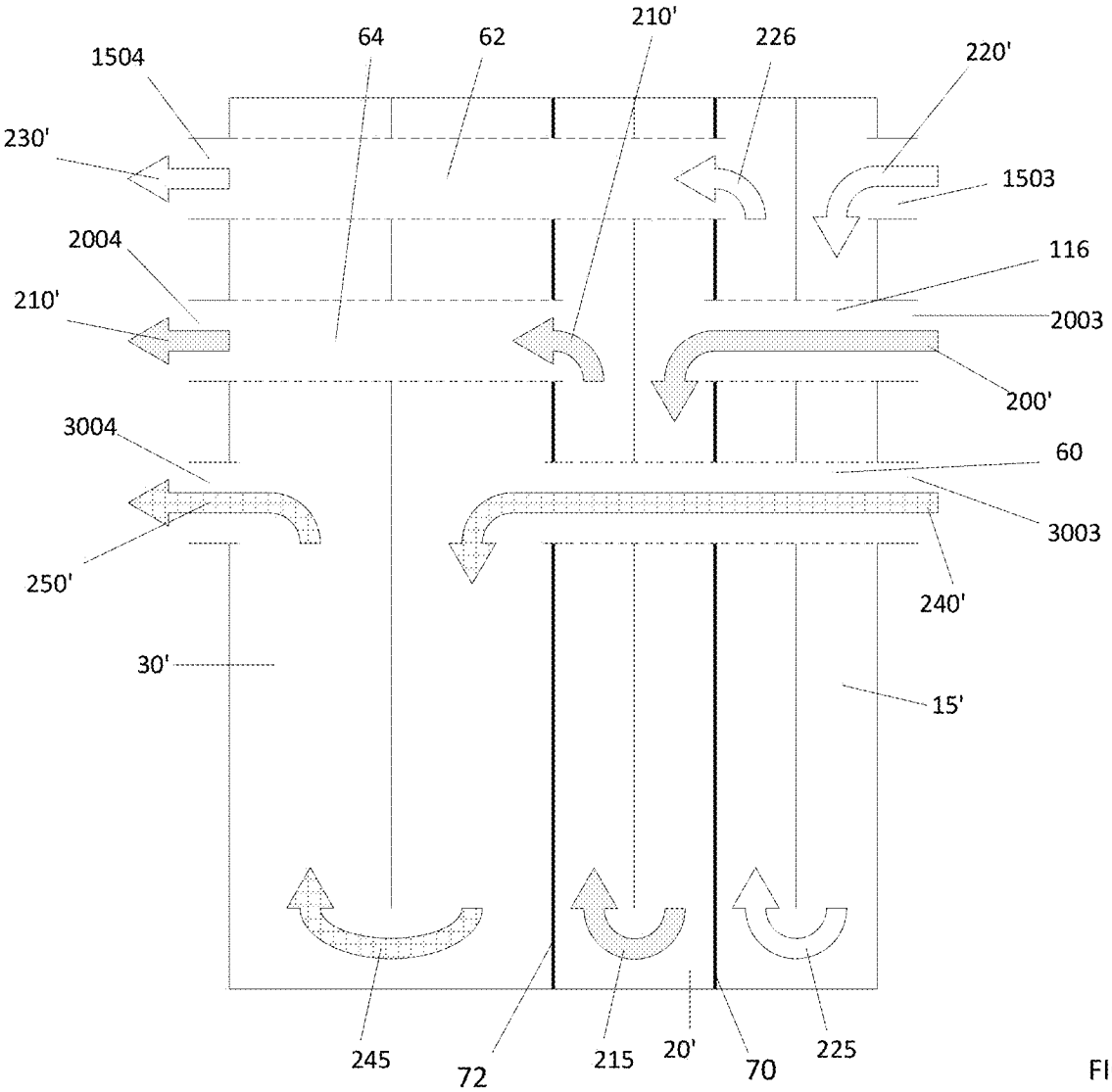
FIG. 3 shows the heat transfer medium portion of a three zone heat exchanger.

FIGS. 2 and 3 show how three heat exchanger zones can be combined into a single physical package, thereby overcoming limitations in the existing art. In FIGS. 2 and 3, a drawing element numbered with a tick mark is used to indicate the physical embodiment of the element shown schematically in FIG. 1.

FIG. 2 shows the working fluid portion of a single physical package, three zone heat exchanger, comprising Z1HE 15', Z2HE 20', and Z3HE 30'. The zones are separated by zone dividers 70 and 72. In the example shown, each zone divider 70 and 72 includes a pair of brazed plates with a first heat exchange media contacting the first brazed plate and a second heat exchange medium contacting the second brazed plate. In those cases in which it is desirable to thermally isolate the two zones, the zone divider may have a thermal barrier designed into one of the two plates. One embodiment of such a thermal barrier is an additional brazed plate with a trapped volume of air or other fluid. In an additional embodiment, the zone divider is a single plate of the appropriate design to isolate the appropriate cavities in the heat exchanger from each other.

As shown in FIG. 2, working fluid 100' enters ASPL 10' and is split into two streams, 105' and 110'. Stream 105' enters Z1HE 15' and flows through this heat exchanger zone. The stream 105' exits Z1HE 15' as heated WF 115' and flows through bypass 55, thereby not intermixing with Z2HE 20'. Working fluid 110' passes through bypass 50, thereby not intermixing with Z1HE 15', enters Z2HE 20', and flows through this heat exchanger zone. The stream 110' exits Z2HE 20' as heated WF 120'.

PMIX 25' is a passive mixer and is that region of Z3HE 30' where the two working fluid streams, 115' and 120', come together and mix. The combined stream, 125', flows through this heat exchanger zone and exits the heat exchanger as heated WF 130'

FIG. 3 shows the flows of the heat transfer mediums through the single physical package, a three zone heat exchanger comprising Z1HE 15', Z2HE 20', and Z3HE 30'. The zones are separated by zone dividers 70 and 72.

As shown in FIG. 3, heat transfer medium 220' enters Z1HE 15' at port 1503, which is equivalent to Z1HE port 3. It flows through this heat exchanger zone and exits the zone as cooled heat transfer medium 230' flowing through bypass 62, thereby not intermixing with Z2HE 20' or Z3HE 30', and exiting the combined heat exchanger at port 1504, which is equivalent to Z1HE 15' port 4.

Heat transfer medium 200' enters the combined heat exchanger at port 2003, which is equivalent to Z2HE 20' port 3. It first passes through bypass 66, thereby not intermixing with Z1HE 15'. It flows through this heat exchanger zone and exits the zone as cooled heat transfer medium WF 210' flowing through bypass 64, thereby not intermixing with Z3HE 30', and exiting the combined heat exchanger at port 2004, which is equivalent to Z2HE 20' port 4.

Heat transfer medium 240' enters the combined heat exchanger at port 3003, which is equivalent to Z3HE 30' port 3. It first passes through bypass 60, thereby not intermixing with Z1HE 15' or Z2HE 20'. It flows through this heat exchanger zone and exits the combined heat exchanger as cooled heat transfer medium WF 250' at port 3004, which is equivalent to Z3HE 30' port 4.

FIGS. 1-3 show an embodiment of the present invention with three heat exchanger zones, however, there is no reason why the number of zones cannot be as few as two or as great as ten or more. The limitations arise from the ability to embed bypasses within the combined heat exchanger as the bypass regions are not performing heat transfer, thus with more bypasses, the size of the heat exchanger zones must increase. Additionally, the embodiment disclosed employs a single working fluid, however, there is no reason why the number of working fluids cannot be greater than one.

Another embodiment of FIGS. 1-3 is a multi zone heat exchanger composed of only the parallel pair of heat exchanger zones without the third heat exchanger zone in series. FIG. 1 would reflect this embodiment schematically if the following components were removed: Z3HE 30, WF 130, and heat transfer media 240 and 250. This heat exchanger unit assembly with a pair of parallel heat exchanger zones would have the same working fluid split ratio control that is advantageous in the three zone parallel/series heat exchanger that was described in detail. What distinguishes this dual zone unit from similar prior art dual zone heat exchangers are the built in bypass regions for the working fluid, prior art dual zone heat exchangers used alternating cavities between the three fluids and there was no provision to split the flow of working fluid to absorb different amounts of heat energy from the two separate heat transfer media. In this invention the working fluid split ratio between the two parallel zones can be either passive controlled by a fixed mechanical device or actively modified by a flow control mechanism that biases the flow toward one of the other passage.

Figure 4:
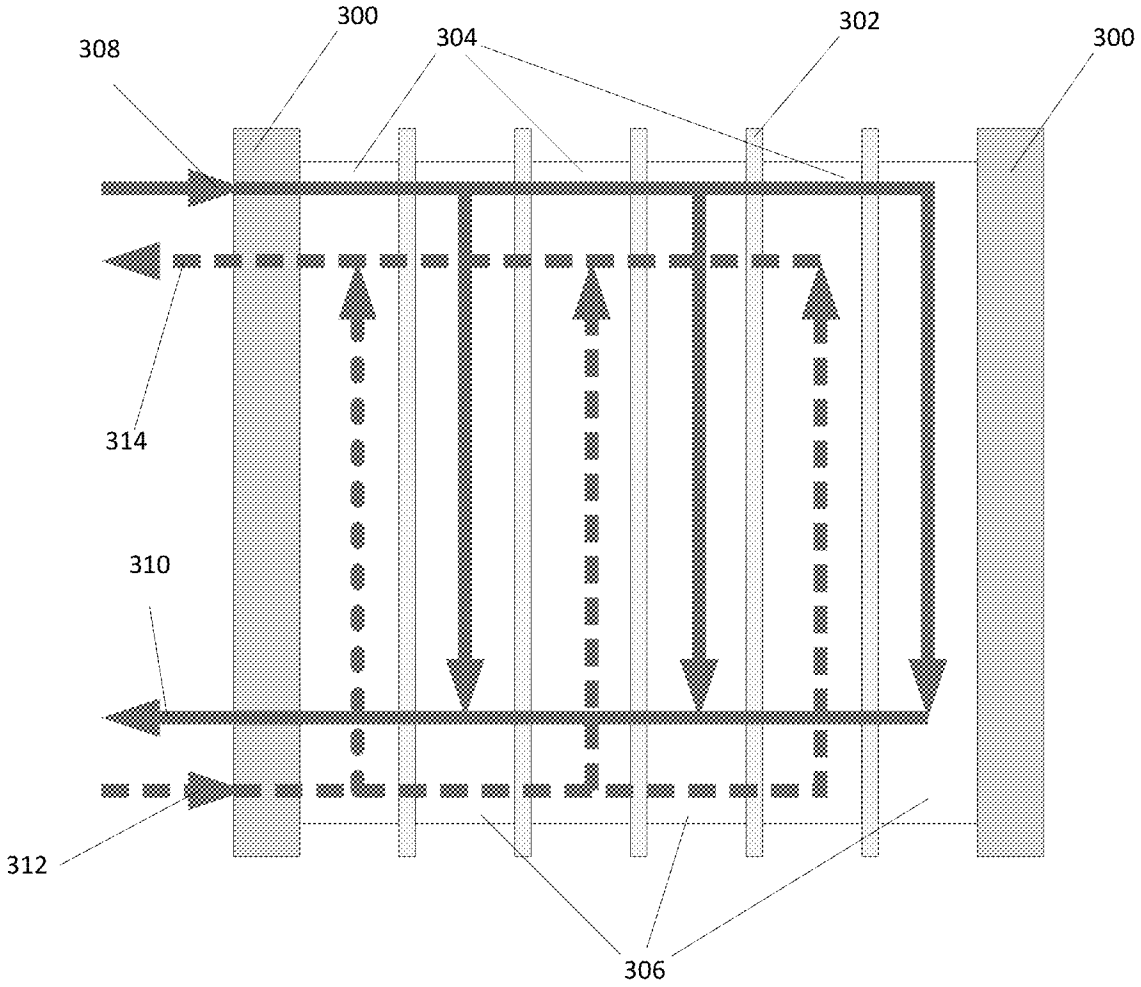
FIG. 4 shows the interaction between the working fluid and heat transfer medium in a heat exchanger zone.

FIG. 4 shows one manner in which the working fluid portion and the heat transfer medium portion of the heat exchanger can be actualized. The method shown is that of a counter-flow, plate heat exchanger, but other methods of heat exchanging known in the art can be used as well.

The core of the heat exchanger shown in FIG. 4 is a stack of parallel flow channels between heat exchanger plates 302. In this case there are six channels separated by five plates 302

The heat exchanger is bounded by optional protective plates 300, similar to insulative zone dividers 70 and 72 in FIGS. 2 and 3. A working fluid stream 308 enters the heat exchanger zone, flows through alternate, parallel channels 306, and exits the heat exchanger zone as heated WF 310. A heat transfer medium 312 enters the heat exchanger zone, flows through alternate, parallel channels 304, and exits the heat exchanger zone as cooled heat transfer medium 314. To bypass a heat exchanger zone, the channels are not opened to the inlet.

FIG. 4 illustrates a counterflow single pass heat exchanger, FIGS. 2 and 3 illustrate heat exchangers sections that are parallel flow and double pass. It is common knowledge in the art that single and multiple passes can be used in parallel flow and/or counter flow arrangements. The multi-zone heat exchanger disclosed herein can embody any and all combinations of single/multiple pass and parallel/counter flow.

Advantages of the multi-zone heat exchanger include the elimination of hoses (which would be needed to join discrete heat exchangers, mixers, and splitters), a reduction in the amount of insulation required (since the multi-zone heat exchanger has less exposed surface area than discrete heat exchangers), a reduction in the number of mounting brackets required (since there are fewer heat exchangers), and a decreased likelihood of leakage (as leaks typically occur at fittings, not within a heat exchanger). These combined reductions amount to a significant reduction in cost, weight, complexity, volume, heat loss and failure risk.

Figure 5:
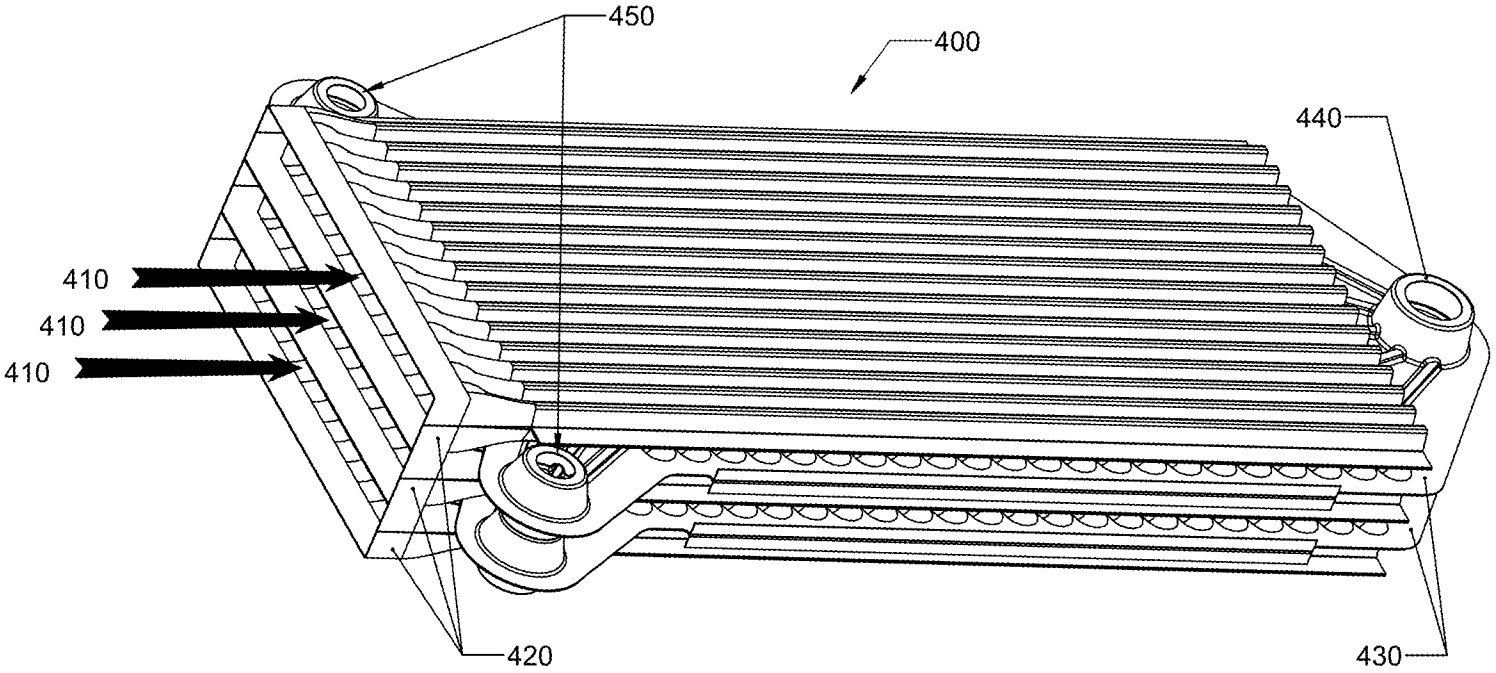
FIG. 5 shows an isometric view of the heat exchanger of an exhaust gas heat exchanger.

A heat exchanger core may be comprised of one or more core segments and FIG. 5 depicts an exemplary heat exchanger core segment 400. Core segment 400 has five layers or flow cavities. A typical plate heat exchanger could have many layers, units in excess of 100 layers are not uncommon, but for purposes of discussion and clarity of the illustrations, this unit is illustrated as having only five layers. Within the core segment 400 of this heat exchanger, the working fluid section and the heat transfer media section will be exposed to radically different temperatures, pressures, and stresses. In one particular embodiment, the heat transfer media is exhaust gas. The heat exchanger embodiment depicted in FIG. 5 is a hybrid BPHE and structurally and thermally has two different heat transfer sections.

Exhaust Gas section (EGS) layers 420 typically have a very low pressure differential to the outside of the heat exchanger, typically under 15 kPa, with extremely high surface temperatures up to 570 C.

Working Fluid section (WFS) layers 430 typically have a high pressure differential to the outside of the heat exchanger, often as great as 7 MPa. The materials and fluid operating temperatures are constrained to a predetermined value defined by the working fluid and WFS layer 430 specifications.

In the example shown in FIG. 5, both of the EGS layers 420 and WFS layers 430 are stacked in alternating layers and brazed together as a single core segment 400. In the core segment 400 the extremely high temperatures are confined to the material in the EGS layers 420 and the high mechanical stresses due to containing the high pressure working fluid are confined to the WFS layers 430. The core segment 400 can be brazed independently and then fixed to an outer case or it can be brazed to an outer case in one brazing. In some embodiments, certain sections, such as the EGS layers 420, may be brazed together in a higher temperature operation and then combined with the WFS layers 430 for additional brazing at a lower temperature. Many variations of brazing and possibly spot welding of sheets at different states of production may be envisaged to optimize the design of this heat exchanger. In one embodiment the EGS layers 420 are not brazed to the WFS layers 420 at the transition area, but are slip fit into them. In this instance the contacting, but not brazed, surfaces from the two zones transmit less heat between them at this point and therefore the material temperature in the WFS layers 430 changes more smoothly, helping avoid a possible large increase in temperature of the highly stressed WFS layer 430 material at the transition zone.

The inlets to the EGS layers 420 may be shaped such that they touch along two sides and form a single combined inlet for the heated exhaust gasses (EG) 410 entering the heat exchanger core segment 400. Heated working fluid exits the core segment 400 at outlet ports 450. These ports may be located to the side of the EGS layers 420 and out of the flow path of the heated EG 410 gasses to prevent this WFS layer 430 structural area from being exposed to the extreme high temperatures of the incoming EG 410. The outlets ports 450 may be arranged as a pair of ports, one on each side of the EGS layers 420 or combined into a single port on one side. When the EG 410 exits the core segment 400, it is at a low enough temperature that it is not a threat to the WFS layers 430. In this embodiment, cool working fluid enters the core segment 400 at a single working fluid inlet 440. If acidic condensation in the cooled EG 410 or other similar conditions, are considered a risk, the working fluid inlet port 440 may be moved to one side similar to the side location of the WF outlet ports 450. This allows the cooled EG 410, with its entrained acidic condensate, to flow straight out of the EGS layers 420 without contacting the structure of the WFS layers 430 and risking acidic corrosion damage to the highly stressed inlet fluid port 440 portion of the WFS layers 430. Further the working fluid inlet port 440 can be split into two ports, one on each side.

The WFS layers 430 would typically be manufactured in a manner similar to current BPHEs. This allows for economical construction with reasonably low cost materials and current industry standard low risk production techniques. In standard BPHEs, it is common to use 0.4 mm thick sheets of 316 stainless steel brazed with either copper or nickel base filler. Typical BPHE's comprise alternating sheets with a pattern of depressions stamped into the sheets which are brazed together. While not needing to be perfectly round, the shape of these depressions makes a structural part similar to a half cylinder. These half cylinders shapes in the sheets interlock with each other and form a very strong structure that can be approximated as a cylindrically shaped pressure vessel. Heat exchangers in the current art have flow passages approximately 9.5 mm in diameter which are rated for 3 MPa at 225 C for copper and 3 MPa at 400 C for nickel based braze fillers. In one embodiment of the present disclosure, the WFS layers 430 flow passage diameter is reduced to approximately 3.2 mm and the sheet thickness is reduced to less than 0.22 mm, thereby allowing a higher operating pressure of 7 MPa with a thinner sheet while significantly reducing the cross section of the WFS layers 430. This allows transferring more energy at an operating pressure conducive to high WHRS thermal efficiency with a lighter weight heat exchanger. The rate of heat transfer is fundamentally proportional to surface area and inversely proportional to sheet thickness between two different heat transfer media. The use of thinner sheet material in the heat transfer partition provides a triple benefit, the materials are lighter for the same amount of heat transfer surface area, and because they transfer more energy per surface area, the weight savings increase even more by having even less surface area. Basically by cutting the sheet thickness in half, there will only be the need for half of the original surface area to transfer the same amount of heat energy. With half the thickness for half of the surface area, the sheet weight is now reduced by a factor of four. With the surface area halved, the pressure drop through the heat exchanger has been significantly reduced, allowing an increase in media velocity to achieve the same pressure drop. This increased velocity further increases the heat transfer coefficient, allowing an addition decrease in sheet surface area with an according drop in cost, volume and weight.

The reduced cross section area of the fluid flow passages in the WFS layers 430, which are smaller than those in standard BPHE's, not only benefit the WFS layers 430 of the heat exchanger system with lighter weight and higher heat transfer, they are also needed because of the magnitude of the flow volume difference of the two media. ICE exhaust gas has a density of approximately 1.16 kg/m$^3$ at 550 C and 100 kPa absolute. Working fluids, such as R245fa, have a density of 355 kg/m$^3$ at 230 C and 7 MPa. Rankine media mass flow rate is known to be approximately twice the flow rate of the exhaust gas mass flow rate. Thus the volume flow ratio of exhaust gas to rankine media is approximately 150:1, which makes it necessary to reduce flow passage cross-section area of the WFS layers 430 as much as possible.

The limitation of how small the pressure chamber can be made is a function of several parameters. These include, the ratio of the WFS layer 430 flow passage diameter to sheet thickness (hoop stress), the limit of how thin the stainless sheet can be made before it becomes easily damaged, how small the passages can be before brazing starts to fill them, and how small a feature can be consistently stamped into the chosen thickness of sheet.

As the complete heat exchanger segment will be built up of the alternating layers of WFS layers 430 and EGS layers 420, the cross-sectional width for both will be the same. This means that the area ratio difference between the WFS layers 430 and the EGS layers 420 will need to be made up with a difference in flow path height between the WFS layers 430 and EGS layers 420. Using a volume flow ratio of 150:1 and a 430 flow passage diameter of 3.2 mm, the flow path in the EGS layer 420 would require a height of approximately 480 mm. This ratio is clearly impractical but illustrates the starting point from which design compromises will start and with an emphasis on designing the flow passage diameter in the WFS layers 430 to be as small as reasonable.

The cross section flow area ratio between the WFS layers 430 and the EGS layer 420 does not have to be proportional to the volume flow ratio. Helping to reduce the desired flow cross section area ratio is the inherent blockage of the structural brazing features of the WFS layers 430, which could effectively block off two-thirds of the effective cross section. Another significant factor is the allowable pressure drop in the two different sections. In certain ICE embodiments, it is also imperative that the pressure drop in the EGS layers 420 be minimized to mitigate impacting the efficiency of the ICE, which is typically restricted to be less than 10 kPa. The pressure of the ICE exhaust stream will be very close to the ambient pressure outside of the heat exchanger body. On the other hand, the pressure of the Rankine media will be significantly higher, 7 MPa, as compared to an atmospheric pressure of 100 kPa. A larger pressure drop in this side of the heat exchanger can be easily offset by increasing pump output pressure slightly in the WHRS, or giving up a small amount of pressure ratio across the WHRS turbine. If the peak pressure drop in the EGS layers 420 were limited to 5 kPa and the peak pressure drop in the WFS layers 430 were limited to 200 kPa this would provide a further area ratio adjustment of approximately 6.3:1. A pressure increase of 200 kPa for the pressure pump already producing 7 MPa would have a negligible effect on the complete system thermal efficiency, but will significantly reduce the mass and volume of the heat exchanger.

Aggregating the effects of the volume flow ratio with the effects of the pressure drop ratio, structural blockage, and the viscosity and heat transport properties of the different fluids, in certain embodiments, the section height ratio of EGS layer 420 to the WFS layer 430 may be between 5:1 to 10:1. Typical BPHE have a 1:1 ratio for all the layers, the greater than 1:1 ratio is one of the benefits of the hybrid BPHE design.

Figure 6A:
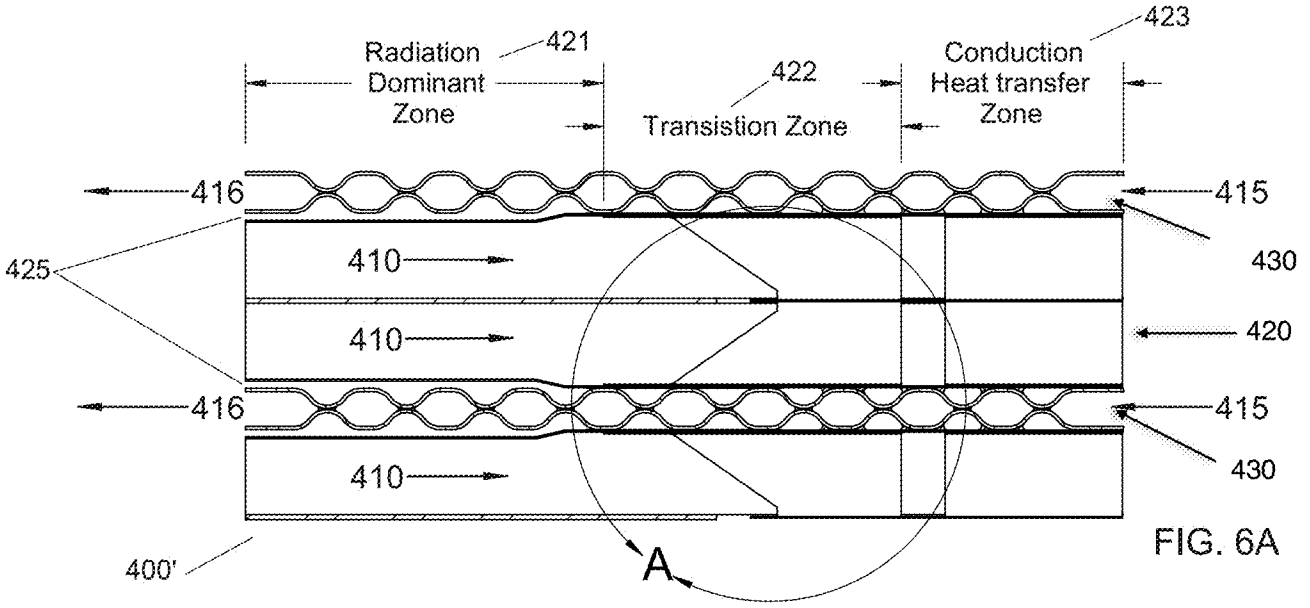
FIG. 6A shows a side view of an internal cutaway illustrating the 3 different heat transfer zones in the Exhaust Gas Section.

FIG. 6A illustrates the internal passages for this heat exchanger design. For illustrative purposes, core segment 400' is made up of two WFS layers 430 sandwiching a single EGS layer 420, with an additional half EGS layer 420 at the bottom. From the right, cool WF 415 flows into the two WFS layers 430 and exits to the left as heated WF 416. ICE exhaust gasses 410 flow into the EGS layers 420 from the left. In some examples, EG 410 enters at approximately 570 C and may exit core segment 400' to the right as cool at 50 C.

A novel aspect of the current disclosure is the division of the flow path in the EGS layers 420 into three distinct zones of operation; radiation dominant (radiation zone 421), transition (transition zone 422), and conduction dominant (conduction zone 423). The premise is that what would be an extremely high heat transfer coefficient due to a temperature delta of 300 C is lowered where the EG 410 temperature is the highest, thereby protecting the WFS layers 430 and the WHRS working fluid from being damaged while still effectively transferring energy. Similarly, the heat transfer coefficient is raised as much as possible where the EG 410 temperature is lowest and not a threat to either the WFS layers 430 of the WHRS working fluid. The radiation zone 421 and conduction zone 423 may be made from the same formed sheet, but may have completely separate structures and shapes, although they will necessarily fit into the same cross sectional area in between the alternating WFS layers 430. For structural reasons, WFS layers 430 will typically be constant cross section throughout with the exception of the area incorporating the working fluid inlets and outlets.

The radiation zone 421 of the flow path starts at the EG 410 inlet and experiences the highest material temperatures. The operational principal of the radiation zone 421 is to allow the flow path material in the EGS layers 420 to reach very high temperatures, temperatures close to the EG 410 flow temperatures, and be free to expand as needed without the material experiencing any significant material stress due to restrained thermal expansion. The application of this zone allows maintaining the EGS layers 420 in such a low stress state, the pressure difference between it and the cavity outside of it being negligible, as it will only be directing the gases and transferring heat energy by radiation. Because of the low stress in this zone, these parts may be extremely thin, nominally 0.12 mm thick. This greatly reduces the thermal resistance of the material and greatly increases the surface area to mass ratio.

The material surface of the radiation zone 421 sheets should have a high emissivity. This exterior surface finish may be a coating or a chemical finish, such as black oxide. A similar surface treatment may be considered for the exterior surfaces of the WFS layers 430 to enhance its absorption of the radiated energy.

At the very beginning of the flow path in the EGS layers 420, where the material is the highest temperature, there may be too much heat transfer from radiation. If this is the case, the material in this region might need to be made thicker to add thermal resistance. This could be done in several ways, by brazing in additional metal or possibly by adding a thermal coating to one or both sides. In another embodiment, the space could be filled with a material which reduces the rate of raditation heat transfer. In certain embodiments, combinations of these approaches may be employed.

The radiation zone 421 flow path materials could be completely physically isolated from the surface of the WFS layers 430 with an air gap 425 for part or all of its length. Optionally, some physical contact between the EGS 420 flow path and the outer surface of the WFS layers 430 may be employed to increase heat transfer due to conduction as heat transfer due to radiation diminishes. Such contact areas are not brazed.

Figure 6B:
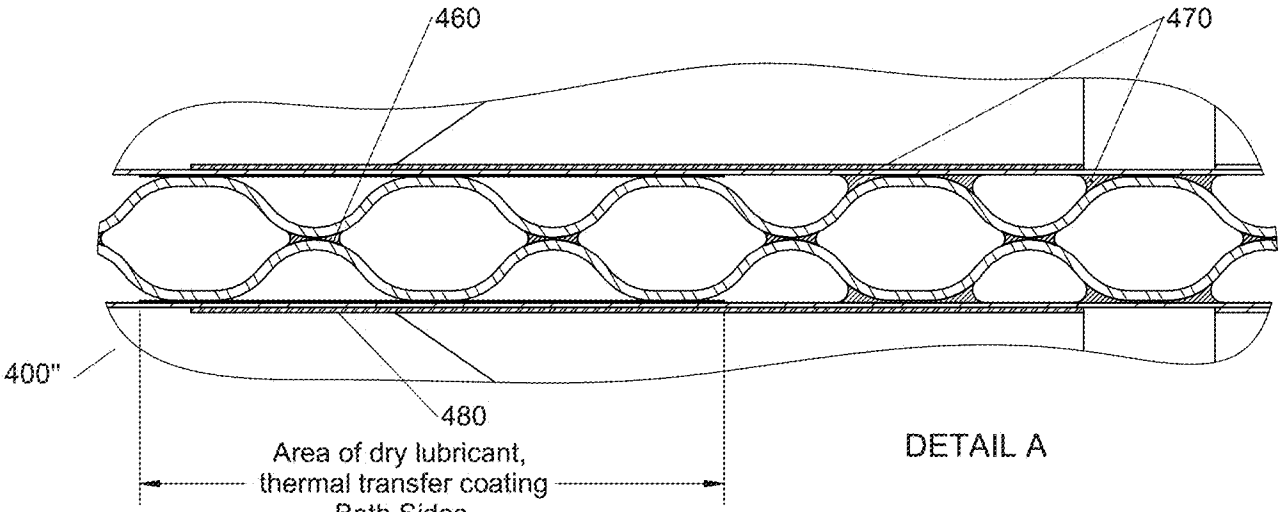
FIG. 6B shows an enlarged view of FIG. 6A illustrating the different brazing joints and a conductive layer between the Working Fluid Section and the Exhaust Gas Section

FIG. 6B Shows an enlarged view of FIG. 6A detailing the brazing and contact area of the transition zone 422. In the area where the plates contact but are not brazed together, a dry film lubricant 480 may be used protect the two surfaces from fretting or abrasion damage due to the expansion and contraction of the EGS layers 420 at each thermal cycle event. The dry film lubricant 480 could have a secondary function as a heat transfer media allowing some conduction heat transfer in addition to radiation. Also detailed in this figure are the braze joints 470 that form the conduction heat transfer path between the EGS layer 420 material and the WFS 430 layers. Braze joints 460 are the structural braze joints that withstand the high operating pressures of the WF 415. It is these braze joints throughout the entire WFS layer 430 that need to be kept under the critical design temperature in order to prevent structural failure.

The conduction zone 423 of the EGS layers 420 is where the temperature of the exhaust gas is cool enough that there are reduced thermal stresses across the opposing heat transfer surfaces of the EGS layers 420 and the WFS layers 430. In this zone, the material in the EGS layers 420 is brazed to the outer surface of the WFS layers 430 to allow good thermal transfer by conduction. The difference in temperature between the EG 410 and working fluid is sufficiently small that radiation heat transfer will be negligible. In this area the EGS layers 420 and WFS layers 430 are one structural unit, but it should be remembered that the majority of stresses due to the pressure of the working fluid are taken up in the internal brazing of the WFS layers 430. The only significant stresses existing in the EGS layers 420 (e.g., flow path materials and brazing) are the thermal stresses due to the temperature difference between the two media and the minor mechanical loads holding the layers together and attaching the heat exchanger core segment 400 to the outer case.

In between the radiation dominant and the conduction zones of the EGS flow path is the transition zone 422. This area will see abrupt temperature and stress changes at the point where the EGS layer 420 is first brazed to the WFS layers 430. Part of this transition stress change is addressed by having the previously described unbrazed contact between the EGS layer 420 and the outer wall of the WFS layers 430. This contact area reduces the concentration of mechanical stresses and also reduces the abruptness of the temperature change that will happen at the point where the brazing together of the two path materials initiates conductive heat transfer. By having unbrazed contact, conductive heat transfer will have already started and the WFS skin temperature would already be approaching the higher temperature that the material at the brazed joint would see.

Figure 7:
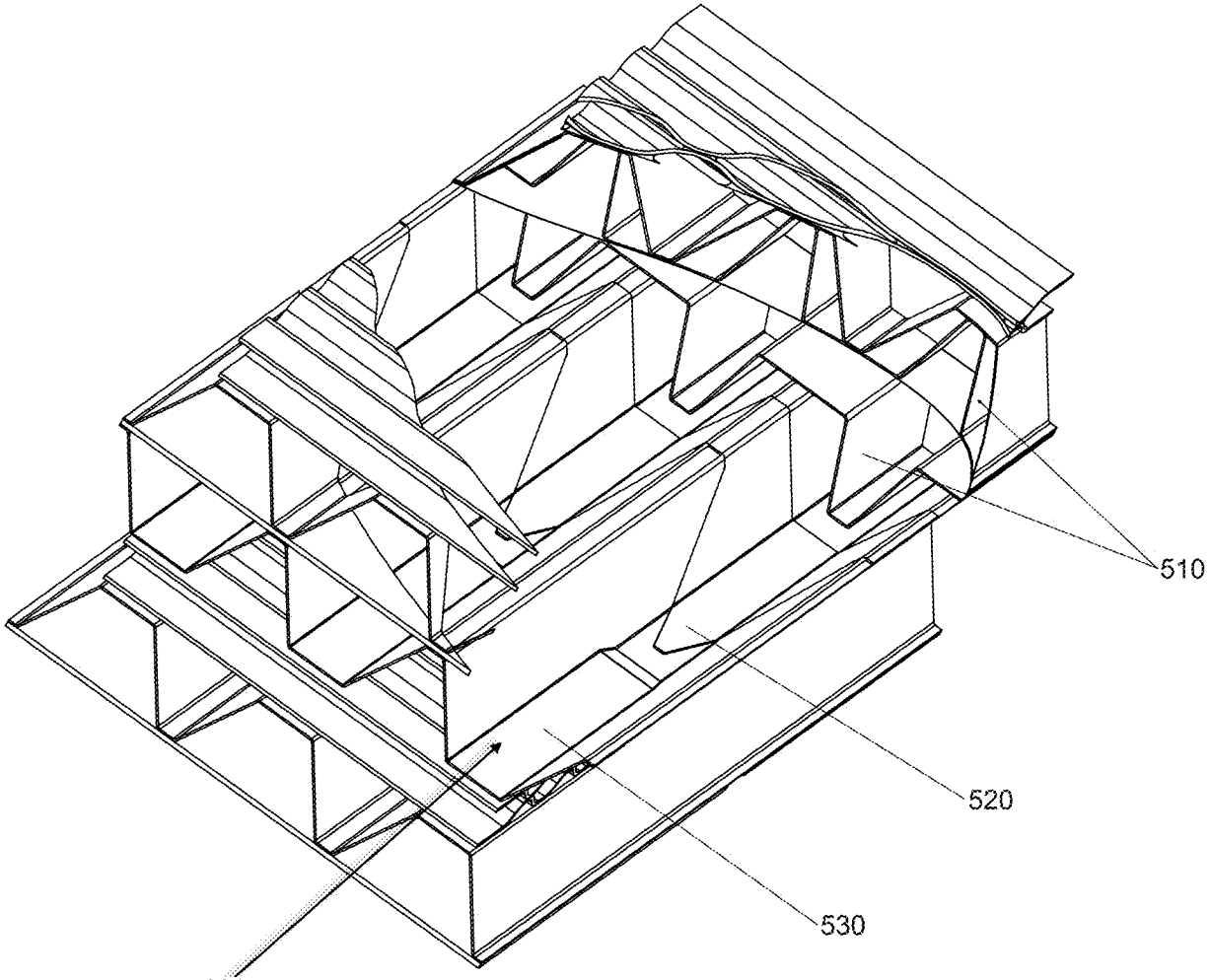
FIG. 7 shows an isometric view of a an internal cut away illustrating the brazed in extra fin material and transition area material.

Another approach for reducing the abrupt temperature change in the transition zone 422 is to thicken the material of the EGS layers 420 for a short distance before and after the initiation of the braze attachment to the WFS layers 430. FIG. 7. illustrates an isometric cutaway of a heat exchanger core section, which illustrates the addition of a short section of material 520 brazed to the inside of the EGS layers 420 flow path cavity. The added material may taper to a point as it extends upstream in the EGS flow path, thereby lengthening the transition line of the discontinuity. As the EG 410 temperature drops in the conduction zone 423, additional fin material may be added in the EGS 420 flow path. These extra fins 510 are brazed along with the transition thickening material 520, if used, to the primary flow path sheet 530 in the EGS layers 420 in the appropriate zone. Depending on the particular design, the flow path sheet 530 may be made in several sections and need not be a continuous piece of material along the flow direction. Along the direction of EG 410 flow, the shape and configuration of the EGS layers 420 may change and be made of individual discrete sections. One reason for a discontinuous flow path is to open up more surface of the WFS layers 430 to the flowing EG 410 which was previously isolated in the EGS layers 420.

Figure 8A:
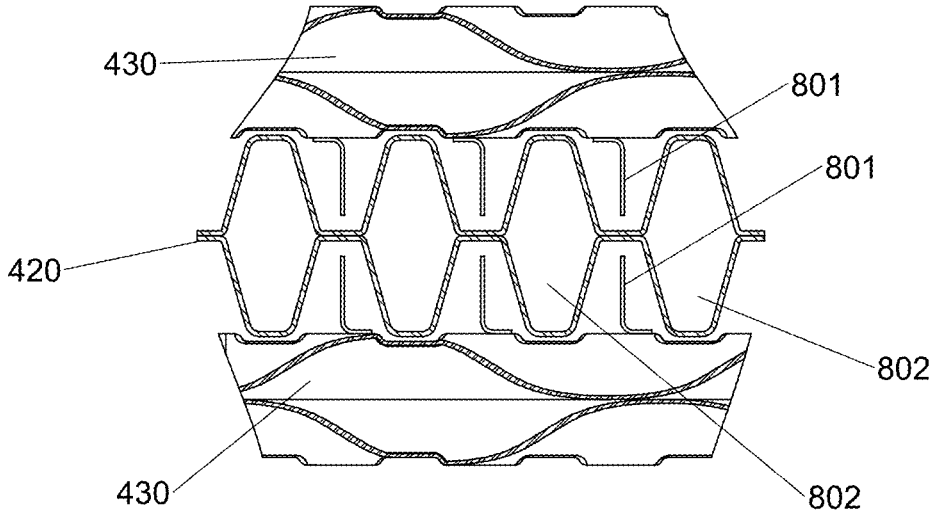
FIG. 8A shows a cross section view along the exhaust gas flow path in illustrating a fin added to absorb radiated heat

FIG. 8A illustrates an alternate embodiment in which additional fins 801 are brazed to the WFS layers 430. These fins 801 protruded vertically up in between the walls of the flow path in the EGS layers 420. The EG 410 flows through areas 802, which are on the opposite side of the EGS layers 420 sheet material from the fins 801. Fins 801 are designed to increase the surface area of the WFS layers 430 to absorb more radiated heat energy from the very hot EGS layers 420. Use of such fins 801 can increase the available surface of the WFS layers 430 for heat absorption more than threefold. The tips of the vertical part of the fin 801 may exceed the desired limited structural temperature of approximately 300 C for the WFS layers 430, but this area of the fin 801 is under minimal stress and its connection to the outside of the WFS layers 430 is not under the same high mechanical stress as the internal braze joints that contain the high working fluid pressure.

Figure 8B:
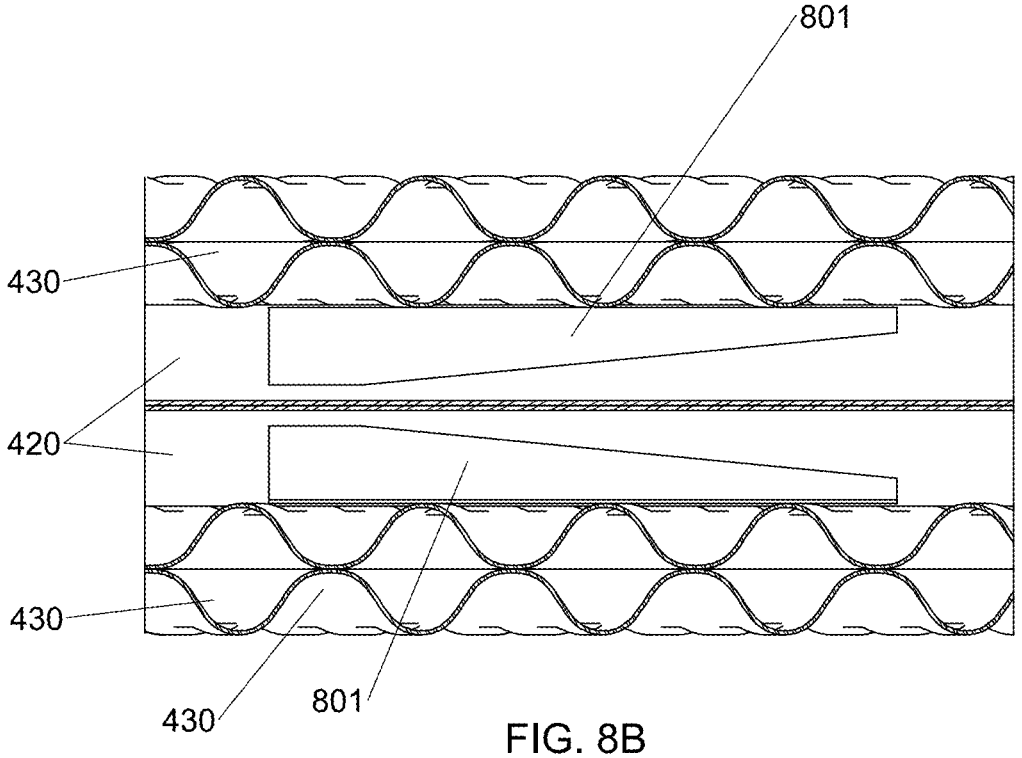
FIG. 8B shows a side view of the added fin in FIG. 8A, illustrating the variable height to control the amount of heat adsorbed from the radiating surfaces.

FIG. 8B is a side view of an alternate fin 801. The fin 801 can be seen attached to the WFS layer 430 and EG 410 is entering the EGS layer 420 from the right. At the entry point the EG 410 are at their highest temperature and the fin 801 is at its shortest height. The variable height of the fin 801 allows tuning the rate of heat transfer in this zone with the height of fin 801 increasing to its maximum as the EG 410 temperature continues dropping as it flows through an EGS layer 420.

Figure 9A:
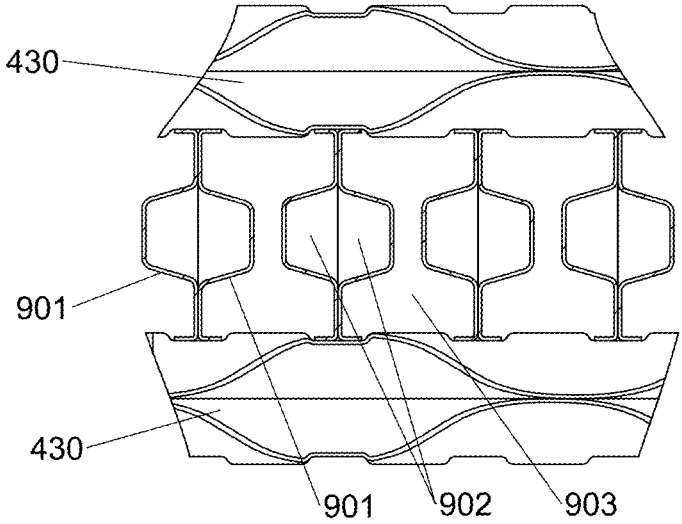
FIG. 9A Shows a flow line cross section of an alternate embodiment of Exhaust Gas Section flowpath fins FIG. 9B Shows a top view of the fins in FIG. 8A illustrating the variable cross section along the path of the exhaust gasses.

FIG. 9A is a cross section view of an optional EGS layer 420 fin 901 configuration in the conduction zone 423. Fins 901 are joined in pairs and brazed to the WGS layer 430 above and below. Inside each pair of fins 901 is a void 902 that EG 410 will not flow through. The result of this void 902 is that between each pair of fins 901 is a reduced flow path area 903 that the EG 410 flows through. The forming of this void 902 has a second effect of increasing the surface area of the fins 901 which increases the rate of heat transfer from the EG 410. As the EG 410 has now been cooled several hundred degrees, its density has greatly increased and it is the function of this reduced flow path cross section area in the EGS layer 420 to keep the velocity of the EG 410 high enough to have good thermal transfer. As the velocity of the EG 410 is allowed to drop the heat transfer coefficient will drop correspondingly.

After traversing a specified distance through the conduction zone 423, the EG 410 temperature will be low enough that the EG 410 may be exposed to the entire surface of the WFS layers 430 without the risk of overheating either the fluid or the structure. At this point the flow path sheets of EGS layers 420 may stop isolating the EG 410 from the outer surface of WFS layers 430 sheets and transition to brazed fin 901 sections that structurally connect the two surrounding WFS layers 430.

Figure 9B:
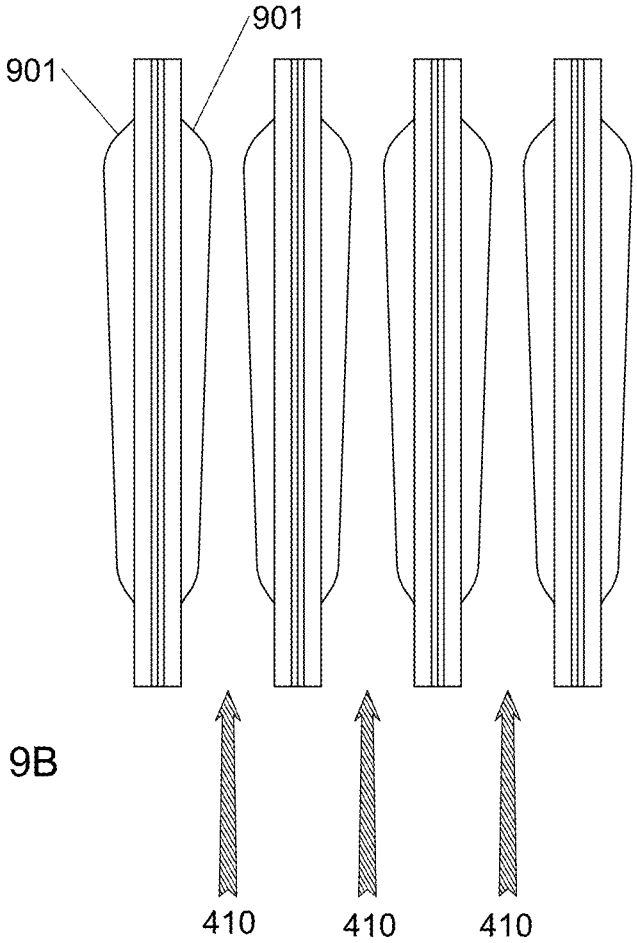

FIG. 9B. shows the fins 901 from the top illustrating how the cross section of the void 902, seen as width from above, increases as the temperature of EG 410 decreases as heat energy is transferred to the WFS layers 430 and the working fluid. At some point the width has increased to its maximum and some point later it should start reducing smoothly to the point where the fins again become flat. This will reduce the pressure drop as the EG 410 smoothly exits the EGS layers 420.

Figure 10:
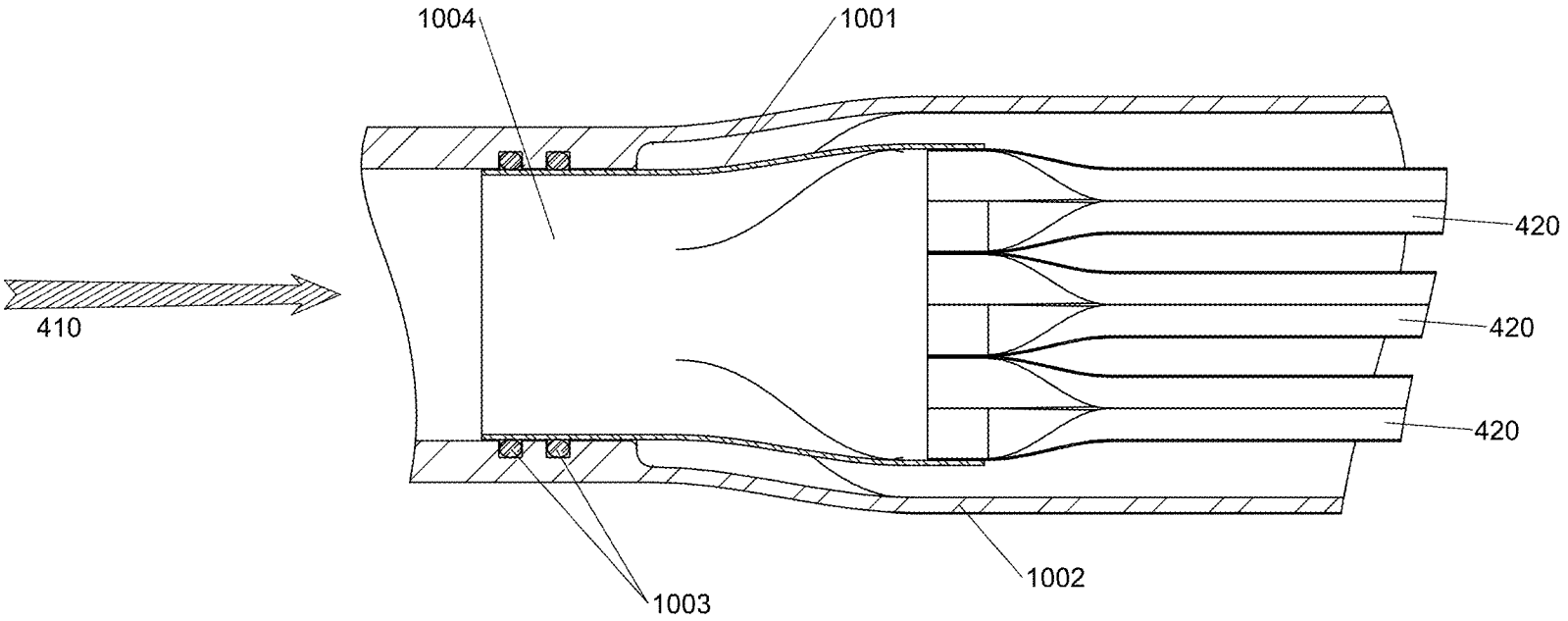
FIG. 10 shows a side view of the combined exhaust inlet for the exhaust gas layers in the heat exchanger core illustrating the freedom to expand in the axial direction.

FIG. 10. Is a section view showing an exhaust gas inlet system. The inlet to the EGS layers 420 may be combined into a single EG inlet fitting 1001, which in one embodiment is configured to end as a round tube 1004. The round tube 1004 may be allowed to move axially to allow thermal expansion of the radiation zone 421 areas of the EGS layers 420. One embodiment of the exhaust gas inlet system employs graphite impregnated packing strips 1003 to seal the EGS inlet fitting 1001 to the stationary outer heat exchanger case structure 1002 while allowing axial movement of the EGS inlet fitting 1001. This freedom to move axially for the EGS inlet fitting 1001 keeps the stress and thermal strain levels low in the EGS layers 420 even though the material will see temperature changes in excess of 500 C and a corresponding significant thermal growth in the axial direction.

A valuable embodiment is a hybrid BPHE combined into a series parallel three heat exchanger configuration, similar to FIG. 1. The difference between this embodiment and that depicted in FIG. 1 is the deletion of Heat Transfer Media 220, and the rerouting of Heat Transfer Media 250 to connect with Z1HE port 3 instead of exiting to the left of the figure. Part of the hybrid BPHE would be the series heat exchanger, Z3HE 30, and the remainder of the hybrid BPHE would constitute the first of the parallel pair of heat exchangers, Z1HE 15. In this instance the heat transfer media would be the same for this series and parallel heat exchanger, typically the heat transfer medium would comprise hot exhaust gasses that enter the series heat exchanger first. This would be heat transfer medium 240 entering Z3HE port 3 and exiting as heat transfer media 250 at Z3HE port 4. After traversing the series heat exchanger, the exhaust gasses would have dropped significantly in temperature. The redirected Heat Transfer Media 250 will enter Z1HE port 3. These cooler exhaust gasses would then traverse the parallel heat exchanger, Z1HE 15, exchanging whatever residual exhaust gas heat energy to the incoming working fluid that the temperature differences allow. The second of the pair of parallel heat exchangers, Z2HE 20, would have a different heat transfer media from the other two circuits. Most likely this heat transfer media 200 will be low pressure working fluid that has exited the expander in a Waste heat recovery system, and this heat exchanger segment Z2HE 20 will function as a recuperator. All other components of FIG. 1 function as previously described. WF 115 and WF 120 combine at the mixer PMIX 25. This is facilitated in the new embodiment at a new set of inlet ports similar to inlet ports 450 shown in FIG. 5. These new inlet port would be located downstream of inlet ports 440, but upstream of outlet ports 450. The location of these additional ports in heat exchanger 400 would be the functional dividing point splitting the hybrid BPHE into the two series heat exchanger segments Z3HE 30 and Z1HE 15.

Advantages of the hybrid BPHE for exhaust gasses include:

Extremely light weight due to the use of thin materials;

Low cost, due to the use of industry-standard brazing processes, which is allowed due to the physical isolation of the high temperature gasses in a very low pressure and stress area; and Higher effectiveness due to ability reduce the exhaust gas temperatures to very low temperatures and to discharge acidic condensate to a low stress repairable section of the heat exchanger.

While certain representative embodiments and details have been shown for purposes of illustrating the disclosure, it will be apparent to those skilled in the art that various changes may be made without departing from the scope of the disclosure, which is further described in the following appended claims.

What is claimed is:

1. A heat exchanger system comprising:

a working fluid splitter including a working fluid splitter inlet port, a first working fluid splitter outlet port, and a second working fluid splitter outlet port;

a first heat exchanger (HE) including a first HE working fluid inlet port, a first HE working fluid outlet port, a first heat transfer medium inlet port, and a first heat transfer medium outlet port;

a second heat exchanger including a second HE working fluid inlet port, a second HE working fluid outlet port, a second heat transfer medium inlet port, and a second heat transfer medium outlet port;

a third heat exchanger including a third HE working fluid inlet port, a third HE working fluid outlet port, a third heat transfer medium inlet port, and a third heat transfer medium outlet port; and a working fluid mixer including a first working fluid mixer inlet port, a second working fluid mixer inlet port, and a working fluid mixer outlet port; and wherein a first working fluid flow path connects the first working fluid splitter outlet port and the first HE working fluid inlet port;

wherein a second working fluid flow path connects the first HE working fluid outlet port and the first working fluid mixer inlet port;

wherein a third working fluid flow path connects the second working fluid splitter outlet port and the second HE working fluid inlet port;

wherein a fourth working fluid flow path connects the second HE working fluid outlet port to the second working fluid mixer inlet port;

wherein a fifth working fluid flow path connects the working fluid mixer outlet port to the third HE working fluid inlet port;

wherein a total mass of working fluid exits the heat exchanger system through the third HE working fluid outlet port; and wherein the first, second, and third heat transfer medium inlet ports are in fluid communication with first, second, and third heat transfer medium sources, respectively, and wherein at least two of the first, second, and third heat transfer medium sources are different sources.

2. The heat exchanger system of claim 1, wherein the first and second heat exchangers are in parallel.

3. The heat exchanger system claim 2, wherein one of the first and second heat transfer medium inlet ports is in fluid communication with an expander outlet port of an expander.

4. The heat exchanger system of claim 3, wherein a heat transfer medium exiting the expander outlet port is a low pressure working fluid.

5. The heat exchanger system claim 4, wherein the one of the first and second heat transfer medium inlet ports is a recuperating heat exchanger that preheats the low pressure working fluid.

6. The heat exchanger system of claim 1, wherein one of the first and second heat transfer medium sources is charge air exiting one of a supercharger and turbocharger.

7. The heat exchanger system of claim 1, wherein the third heat transfer medium source is engine cooling jacket water.

8. The heat exchanger system of claim 1, wherein a ratio of a first working fluid mass flow through the first heat exchanger to a second working fluid mass flow through the second heat exchanger is controlled passively by different values of restriction for the first and second working fluid mass flows built into the working fluid splitter.

9. The heat exchanger system of claim 8, wherein the different values of restriction comprise orifice sizes.

10. The heat exchanger of claim 1, wherein the ratio of a first working fluid mass flow through the first heat exchanger to a second working fluid mass flow through the second heat exchanger is controlled actively by the working fluid splitter, and wherein the ratio can be changed by an external control system.

11. The heat exchanger of claim 1, wherein the ratio of a first working fluid mass flow through the first heat exchanger to a second working fluid mass flow through the second heat exchanger is controlled passively by different values of restriction for the first and second working fluid mass flows built into the working fluid mixer.

12. The heat exchanger system of claim 11, wherein the different values of restriction comprise orifice sizes.

13. The heat exchanger system of claim 1, wherein the working fluid and the heat transfer medium flow in opposite directions to each other within at least one of the first, the second, and the third heat exchangers.

14. The heat exchanger system of claim 1, wherein one of the first, second, and third heat transfer medium sources is engine cooling jacket water.

* * * * *